US008397825B1

(12) United States Patent
Odom et al.

(10) Patent No.: US 8,397,825 B1
(45) Date of Patent: Mar. 19, 2013

(54) HYDRAULIC LUBRICATING SYSTEM AND METHOD OF USE THEREOF

(76) Inventors: Larry G. Odom, Elk City, OK (US); Troy Rodgers, Chickasha, OK (US)

( * ) Notice: Subject to any disclaimer, the term of this patent is extended or adjusted under 35 U.S.C. 154(b) by 0 days.

(21) Appl. No.: 12/776,864

(22) Filed: May 10, 2010
(Under 37 CFR 1.47)

Related U.S. Application Data

(63) Continuation of application No. 11/731,847, filed on Mar. 30, 2007, now abandoned.

(60) Provisional application No. 60/787,264, filed on Mar. 30, 2006.

(51) Int. Cl.
*E21B 19/00* (2006.01)
*E21B 19/22* (2006.01)
*E21B 33/06* (2006.01)

(52) U.S. Cl. ..... 166/379; 166/77.4; 166/85.3; 166/85.4; 166/86.2; 166/84.1

(58) Field of Classification Search ..... 166/379, 166/77.4, 85.3, 85.4, 86.2, 84.1
See application file for complete search history.

(56) References Cited

U.S. PATENT DOCUMENTS 2,336,977 A * 12/1943 Bean et al. ..... 166/97.1
3,920,076 A 11/1975 Laky
4,368,871 A 1/1983 Young
4,681,168 A 7/1987 Kisling, III
4,852,648 A * 8/1989 Akkerman et al. ..... 166/66.4
4,915,178 A 4/1990 Goldchild
4,940,095 A 7/1990 Newman
5,285,852 A * 2/1994 McLeod ..... 166/379
5,823,267 A 10/1998 Burge et al.
5,944,099 A 8/1999 Sas-Jaworsky
6,015,014 A 1/2000 Macleod et al.
6,457,520 B2 10/2002 Mackenzie et al.
6,520,255 B2 2/2003 Tolman et al.
6,609,571 B2 8/2003 Nice et al.
6,695,064 B2 * 2/2004 Dallas ..... 166/382
6,719,061 B2 4/2004 Muller et al.
6,745,840 B2 6/2004 Headworth
6,817,423 B2 * 11/2004 Dallas ..... 166/382
6,827,147 B2 12/2004 Dallas
6,834,724 B2 12/2004 Headworth
6,913,084 B2 7/2005 Boyd
6,973,979 B2 12/2005 Carriere et al.
7,032,658 B2 4/2006 Chitwood et al.
7,040,410 B2 5/2006 McGuire et al.

* cited by examiner

*Primary Examiner* — Cathleen Hutchins
(74) *Attorney, Agent, or Firm* — Crowe & Dunlevy

(57) ABSTRACT

A hydraulic lubricator assembly includes a spool for enclosing a downhole tool, wherein the spool comprises an upper end and a lower end. The hydraulic lubricator assembly further includes a pressure isolation connector attached to the upper end of the spool, wherein the pressure isolation connector includes a lower packing gland and an upper packing gland. A hydraulic assembly is positioned above the pressure isolation connector, wherein the hydraulic assembly comprises a rod connected to the downhole tool, and wherein the hydraulic assembly lowers the downhole tool into the wellbore.

2 Claims, 4 Drawing Sheets

HYDRAULIC LUBRICATING SYSTEM AND METHOD OF USE THEREOF

RELATED APPLICATIONS

This application is a continuation of U.S. patent application Ser. No. 11/731,847, entitled Hydraulic Lubricating System, filed Mar. 30, 2007, which in turn claims the benefit of U.S. Provisional Patent Application Ser. No. 60/787,264, entitled Hydraulic Lubricating System, filed Mar. 30, 2006, the disclosure of which are hereby incorporated by reference.

FIELD OF THE INVENTION

The present invention relates generally to the production of petroleum products from subterranean wells. The present invention more particularly relates to the assembly of downhole equipment before deployment into a subterranean well.

BACKGROUND OF THE INVENTION

Coiled tubing is often used to deploy downhole equipment. Coiled tubing (CT) can be defined as any continuously-milled tubular product manufactured in lengths that require spooling onto a take-up reel. Although initially used primarily for well cleanout and acid stimulation applications, coiled tubing is now used in other applications, including well unloading, fishing, tool conveyance and setting/retrieving plugs. The term "downhole assembly" refers generally to the equipment that is deployed and used in a subterranean well. Electrical submersible pumps, fishing tools and monitoring devices are common examples of downhole equipment.

Coiled tubing units typically include an injector head that is suspended above the wellhead by a crane or derrick. The injector head provides the surface drive force to run and retrieve the coiled tubing from the well. The injector head is often used in conjunction with a stripper and a blowout preventer (BOP). The stripper is typically located between the injector head and the BOP and provides the primary operational seal between pressurized wellbore fluids and the surface environment. The BOP may include one or more rams that perform various functions, including supporting the hanging coiled tubing, sealing around the coiled tubing and shearing the coiled tubing.

One of the drawbacks of using coiled tubing in conjunction with downhole equipment is the process used to connect the downhole equipment to the coiled tubing before lowering the downhole equipment into the well. In the past, a conventional lubricator was used to load tools before running the tools into the live well. The lubricator is a long, high-pressure pipe that is fitted between the top of a wellhead and the bottom of the injector head. The tools are assembled inside the lubricator and connected to the coiled tubing. The lubricator is then pressurized to wellbore pressure and the assembled tools are deployed through the wellhead into the well.

While generally effective, the prior art method of "lubricating" tools into the well suffers significant drawbacks. Most significantly, the use of a lubricator raises the injector head high above the wellbore for the duration of the coiled tubing operation. This requires the use of large cranes or derricks that decrease the cost effectiveness and efficiency of the coiled tubing deployment. Many well sites are too remote or two small to support the use of large cranes or derricks. Furthermore, elevated injector heads are unstable in high winds and pose an increased risk to operators and equipment.

In light of the shortcomings of the existing art, there is a need for an improved apparatus and method for lubricating a downhole assembly into a live well. It is to these and other deficiencies in the prior art that the present invention is directed.

SUMMARY OF THE INVENTION

In a preferred embodiment, the present invention includes a hydraulic lubricator assembly with a spool for enclosing a downhole tool, wherein the spool includes an upper end and a lower end. The hydraulic lubricator assembly further includes a pressure isolation connector attached to the upper end of the spool. The pressure isolation connector preferably includes a lower packing gland to retain the pressure in the spool and an upper packing gland to retain the pressure in a hydraulic assembly. In a preferred embodiment, the upper and lower packing glands each include a packing gland body, a packing gland nut that engages the packing gland body, V-packing, and a packing gland pusher.

The hydraulic assembly is positioned above the pressure isolation connector, and includes a rod connected to the downhole tool. The hydraulic assembly lowers the downhole tool into the wellbore.

The present invention allows the downhole tool to be substantially lowered into the wellbore, and allows the spool to be removed before the coiled tubing injector is attached to the well. Thus, the use of the hydraulic lubricator assembly of the present invention obviates the need for a conventional lubricator under the coiled tubing injector head. As such, the injector head can be operated much closer to the ground with smaller equipment and with reduced risk to person and property.

DETAILED DESCRIPTION OF THE PREFERRED EMBODIMENT

Figure 1:
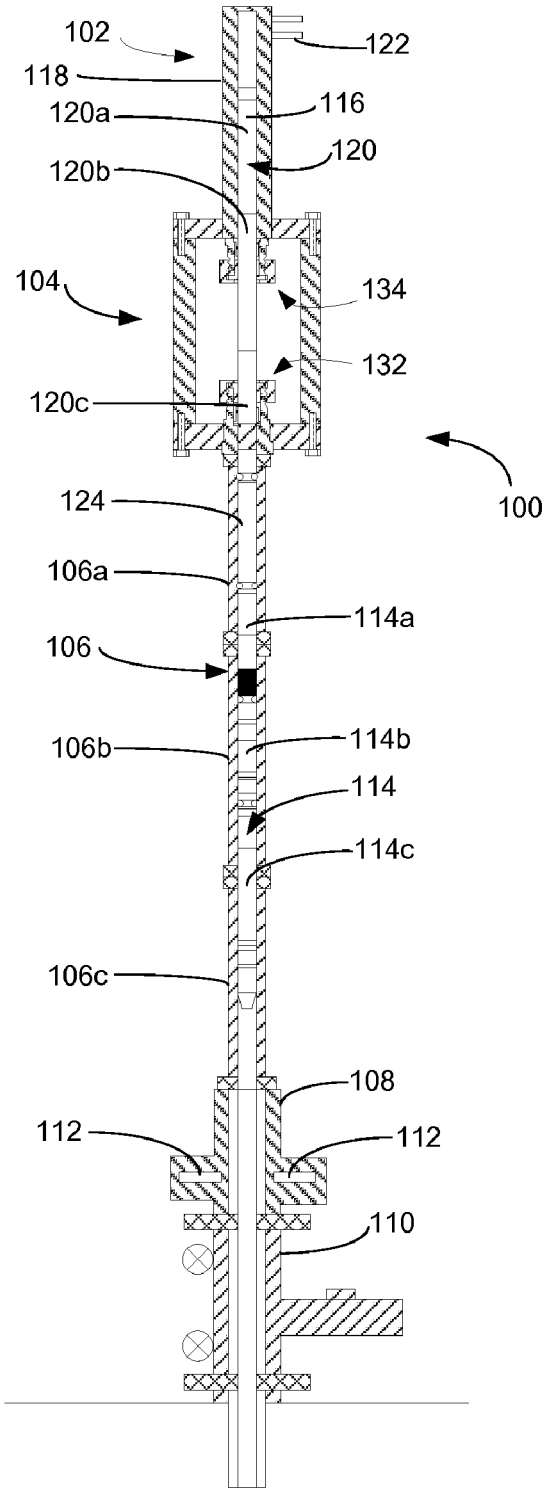
FIG. 1 is a side elevational view of a hydraulic lubricator constructed in accordance with a preferred embodiment of the present invention.

Referring to FIG. 1, shown therein is a hydraulic lubricator assembly 100 constructed in accordance with a preferred embodiment. The hydraulic lubricator assembly 100 preferably includes a hydraulic assembly 102, a pressure isolation connector 104, a spool 106, and a blowout preventer (BOP) 108. The BOP 108 is connected to the top of a wellhead 110. In the preferred embodiment, the hydraulic lubricator assembly 100 is mounted on a truck (not shown) having a derrick or mast sufficient to suspend the hydraulic lubricator assembly 100 over the wellhead 110. It will be understood, however, that the hydraulic lubricator assembly 100 can alternatively be used in offshore applications and mounted on a boat or barge.

The hydraulic lubricator assembly 100 is used to lower a downhole tool, or "downhole assembly 114," into the wellbore. In many cases, the downhole assembly 114 is made up of multiple components 114*a*, 114*b*, and 114*c* that connect together to form the downhole assembly 114. It will be understood that the downhole assembly 114 may be made up of fewer components or more components than are shown in FIG. 1.

The hydraulic assembly 102 preferably includes a cylinder 116 having a bore 118, a rod 120 and pressure couplings 122. The hydraulic assembly 102 is preferably connected to a power pack or hydraulic generator and, unless otherwise specified, is structurally and functionally similar to conventional hydraulic rams.

In the preferred truck-mounted embodiment, a dedicated diesel engine is used to drive the hydraulic power pack (not shown). The rod 120 is preferably constructed in modular rod segments such that additional lengths can be added or removed as needed as spool segments are added and removed, as discussed below. In a particularly preferred embodiment, the top of rod segment 120*b* is configured for threaded engagement with the bottom of rod segment 120*a*. Similarly, the top of rod segment 120*c* is preferably configured for threaded engagement with the bottom of rod segment 120*b*. It will be understood that additional or fewer rod segments may be used.

The hydraulic lubricator assembly 100 also includes a connector sub 124 that serves as a joint between the distal end of the rod 120 and the connected downhole assembly 114. In a presently preferred embodiment, the connector sub 124 is configured as a "pup-joint" with opposing ends capable of being secured to the downhole assembly 114 and the hydraulic rod 120. The functionality of the connector sub 124 is discussed below.

Figure 2:
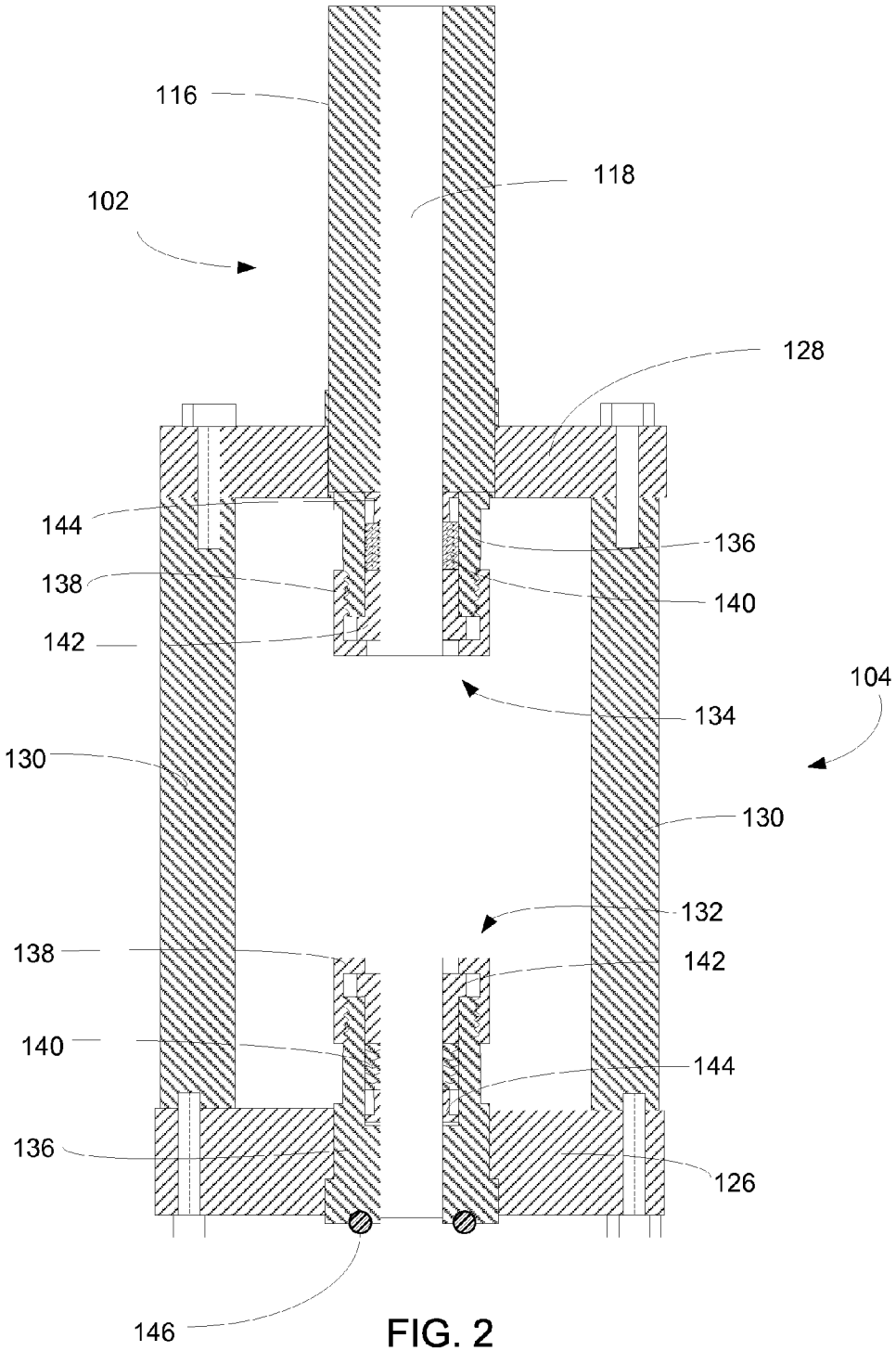
FIG. 2 is a side cross-sectional view of the pressure isolation connector of the hydraulic lubricator of FIG. 1.

The pressure isolation connector 104 is an important component within the hydraulic lubricator assembly 100. As shown in greater detail in FIG. 2, the pressure isolation connector 104 includes a base 126, a top 128 and a series of support posts 130. The base 126 of the pressure isolation connector 104 can be connected to the top of the first spool segment 106*a*. The top 128 of the pressure isolation connector 104 is preferably connected to the cylinder 116 of the hydraulic assembly 102. In a particularly preferred embodiment, the pressure isolation connector 104 is rigidly fixed to the hydraulic cylinder 116 for ease of transportation. The base 126 of the pressure isolation connector 104 is preferably configured to be secured to the top spool segment 106*a* through the use of a plurality of fastening devices (not shown). The pressure isolation connector 104 also preferably includes a lower packing gland 132 and an upper packing gland 134, also called "stuffing boxes."

The lower packing gland 132 is configured to seal around the rod 120 to retain the pressure inside the spacer spool 106. The lower packing gland 132 includes a packing gland body 136, a packing gland nut 138, V-packing 140, an upper packing gland pusher 142, and a lower packing gland pusher 144. Packing gland body 136 of lower packing gland 132 is preferably retained within the base 126 and includes a ring seal 146 adapted to provide a suitable seal between the pressure isolation connector 104 and the top spool segment 106*a*. In a particularly preferred embodiment, the ring seal 146 is constructed from a material that exhibits some degree of elasticity. The packing gland nut 138 engages the packing gland body 136 to improve the seal about rod 120. Packing gland pushers 142 and 144 exert force on the V-packing 140 to tighten the seal around rod 120. In a preferred embodiment, lower packing gland pusher 144 is made of brass.

Similarly, the upper packing gland 134 is configured to seal around the rod 120 to retain the pressure within the hydraulic cylinder 116. Like the lower packing gland 132, the upper packing gland 134 preferably uses a packing gland body 136, a packing gland nut 138, V-packing 140, an upper packing gland pusher 142, and a lower packing gland pusher 144 to seal around rod 120. In this way, the pressure isolation connector 104 isolates the pressure in the hydraulic cylinder 116 from the pressure in the spacer spools 106. The pressure isolation connector 104 is preferably sized and configured to permit the introduction of a counter wheel (not shown) that can track the progression of the rod 120 in and out of the hydraulic cylinder 116.

Turning back to FIG. 1, the spool 106 may be comprised of one or more spool segments 106*a*, 106*b*, and 106*c*. The spool 106 is designed to contain downhole assembly 114 prior to the insertion of the downhole assembly 114 into the wellbore. The number of spool segments depends on the length of the downhole assembly 114. Each spool segment 106*a*, 106*b*, and 106*c* is preferably a 3" diameter, high-pressure spacer spool. In a particularly preferred embodiment, the spool 106 is approximately 30 feet in length, and the spool segments are installed in series.

The BOP 108 is preferably a standard BOP used in coiled tubing operations and should be selected based on the particular requirements of specific applications. The BOP 108 preferably includes a pair of internal rams 112. The BOP 108 may also include one or more pairs of shear rams or blind rams. The BOP 108 may also be attached to other BOPs.

As described below, in a preferred embodiment, the hydraulic lubricator assembly 100 is used to assemble and load a downhole assembly 114 before the downhole assembly 114 is connected to coiled tubing and deployed in the well. The use of the hydraulic lubricator assembly 100 obviates the need for a conventional lubricator under the coiled tubing injector head. Thus, the injector head can be operated much closer to the ground with smaller equipment and with reduced risk to person and property.

In a preferred rig-up procedure, the BOP 108 is bolted to the top of the wellhead 110. Next, the downhole assembly 114 is assembled and placed inside the requisite number of spacer spools. Once the downhole assembly 114 is completely assembled, the connector sub 124 is attached to the top of the downhole assembly 114 and the bottom of the hydraulic rod 120.

In an alternate preferred embodiment, the hydraulic rod 120 is first connected to the connector sub 124, which in turn, is connected to the top component 114*a* within the downhole assembly 114. The next component 114*b* of the downhole assembly 114 is then connected to the top component 114*a*. Once the length of the downhole assembly 114 is greater than the length of the first spool segment 106*a*, the downhole assembly 114 is place in the first spool segment 106*a*, and the spool segment 106*a* is secured to the base 126 of the pressure isolation connector 104. In this fashion, additional spacer spool segments 106*b* and 106*c* are added to the top spacer spool segment 106*a* as the length of the downhole assembly 114 increases. To facilitate assembly, the rod 120 can be extended and retracted to provide easier access to the downhole assembly 114.

Once the downhole assembly 114 has been completely assembled, the spacer spool 106 can be secured between the BOP 108 and the pressure isolation connector 104. Next, the spacer spool 106 is pressurized to wellbore pressure. In a first preferred embodiment, the spacer spool 106 is pressurized using a suitable compressed gas or fluid (e.g., methanol) stored on the truck. Alternatively, the spacer spool 106 can be pressurized with a bypass line connected directly to the wellbore.

Figure 3:
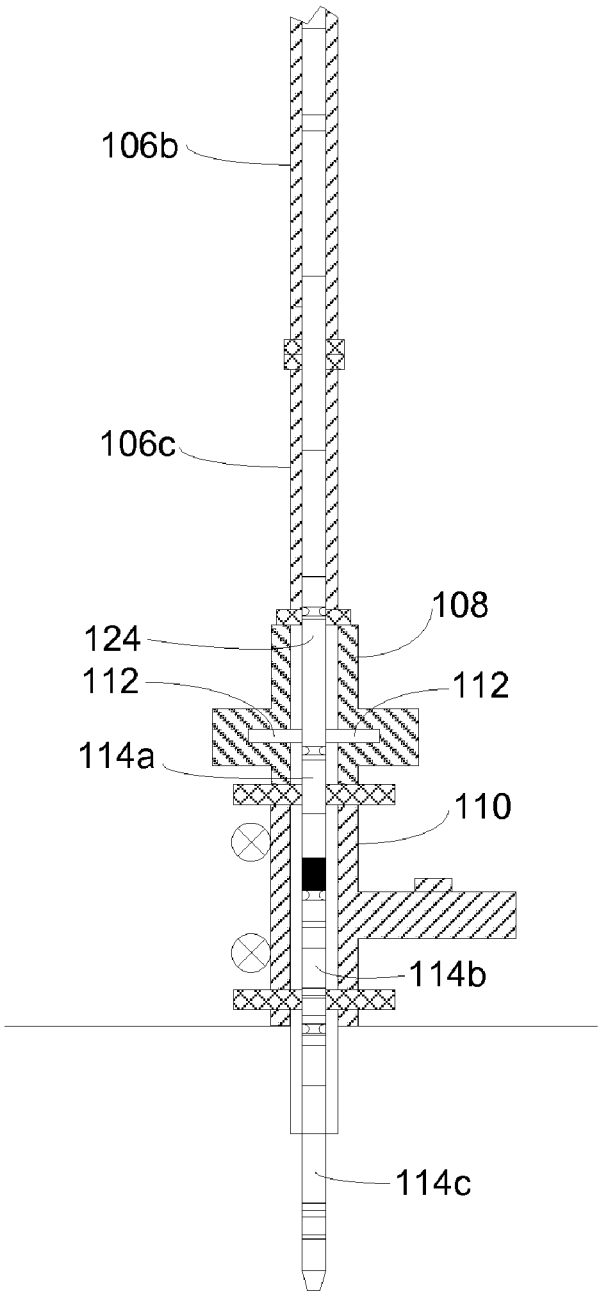
FIG. 3 is a side cross-sectional view of the lower portion of a hydraulic lubricator constructed in accordance with a preferred embodiment of the present invention, after the downhole tool has been partially inserted into the wellbore.

When the pressure inside the spacer spool 106 is balanced with the wellbore pressure, the operator moves the master valve on the wellhead to full open. As shown in FIG. 3, the hydraulic assembly 102 is then activated to push the downhole assembly 114 through the BOP 108 into the well. Once the connector sub 124 reaches the BOP 108, the internal rams 112 are closed to lock the downhole assembly 114 in place. The travel of the hydraulic rod 120 required to move the connector sub 124 through the BOP 108 is measured, preferably with the counter wheel, and recorded.

Next, the pressure in the spacer spool 106 is released and the spacer spool segments 106*a-c* are disconnected from the BOP 108. The rod 120 is then disconnected from the connector sub 124, and the depressurized spacer spool segments 106*a-c*, pressure isolation connector 104, and hydraulic assembly 102 are moved out of the way, or rigged-down. At this point in the operation, the wellbore pressure is retained by the BOP 108, and the downhole assembly 114 is suspended from the connector sub 124. The connector sub 124 is captured by the internal rams 112 of the BOP 108 with the top portion of the connector sub 124 extending above the top of the BOP 108.

Figure 4:
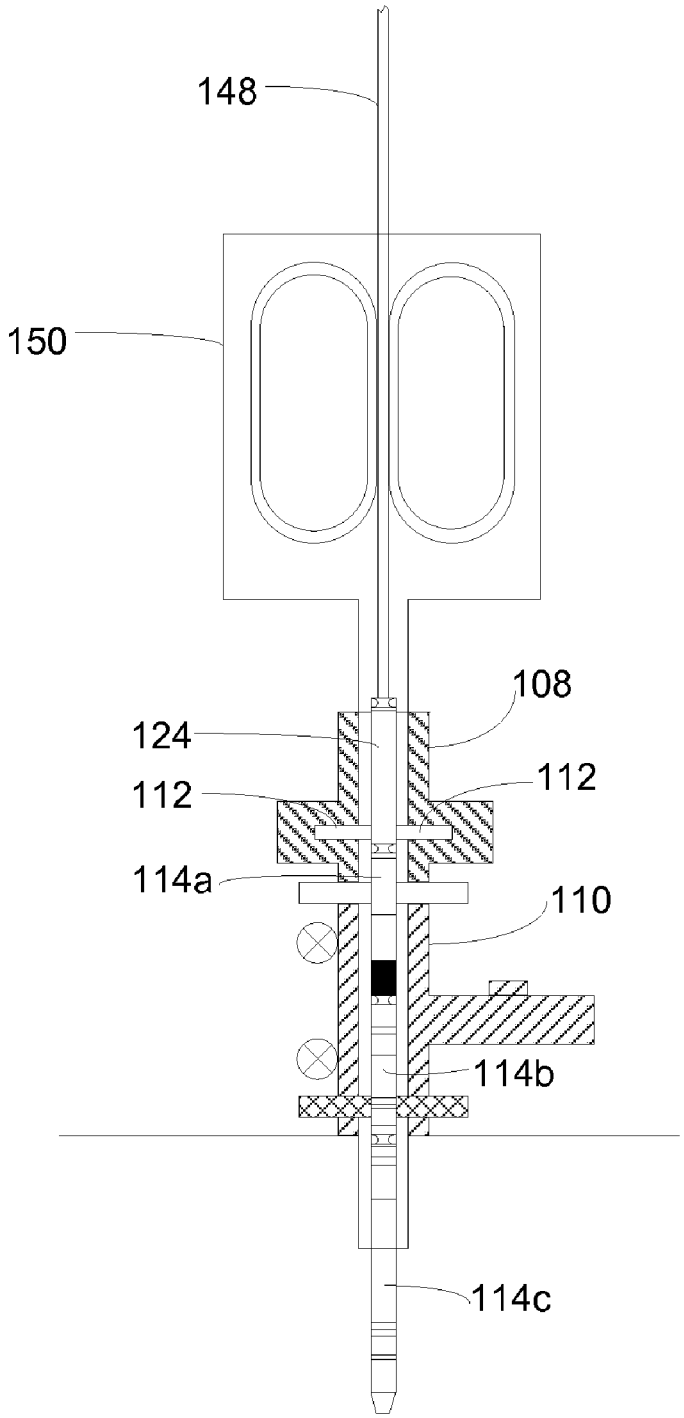
FIG. 4 is a side cross-sectional view of a wellhead, blowout preventer, downhole tool, and coiled tubing injector head after the downhole tool has been partially inserted into the wellbore using the present invention.

Turning to FIG. 4, coiled tubing 148 is then attached to the exposed end of the connector sub 124 and to the coiled tubing injector head 150. Any intervening components, such as additional blowout preventers (not shown), are attached to the top of the BOP 108. Once the intervening components are brought to wellbore pressure, the internal rams 112 are opened and the coiled tubing injector head 150 deploys the downhole assembly 114 into the well.

At the end of the coiled tubing operation, the coiled tubing 148 is retracted until the connector sub 124 is properly positioned adjacent the internal rams 112 of the BOP 108. The internal rams 112 are closed around the connector sub 124, and the injector head 150 and any intervening components can be removed from the well site. The spacer spool 106, hydraulic assembly 102 and pressure isolation connector 104 are then installed and pressurized so that the downhole assembly 114 can be retracted into the spacer spool 106 for disassembly.

Thus, the preferred embodiment provides for a hydraulically powered lubricator that can be advantageously used to load a downhole assembly in a well in a separate operation before connecting coiled tubing and a coiled tubing injector head. The apparatus and method of the preferred embodiment provide an efficient and safe alternative to conventional lubricators used in combination with coiled tubing systems.

It is clear that the present invention is well adapted to carry out its objectives and attain the ends and advantages mentioned above as well as those inherent therein. While presently preferred embodiments of the invention have been described in varying detail for purposes of disclosure, it will be understood that numerous changes may be made which will readily suggest themselves to those skilled in the art and which are encompassed within the spirit of the invention disclosed herein and in the associated drawings. For example, the hydraulic assembly 102, pressure isolation connector 104 and BOP 108 can be cooperatively used for fishing operations that require substantial "push-and-pull" forces.

It is claimed:

1. A method for lubricating a downhole tool into a wellbore, the method comprising the steps of:

installing a blow out preventer to the top of a wellhead, wherein the blow out preventer includes internal rams;

suspending a hydraulic assembly over the wellhead, wherein the hydraulic assembly includes a rod;

connecting a pressure isolation connector to the bottom of the hydraulic assembly, wherein the pressure isolation connector is provided with a lower packing gland and an upper packing gland;

extending the rod through the upper packing gland and lower packing gland of the pressure isolation connector;

assembling the downhole tool;

connecting the assembled downhole tool to the rod;

securing at least one spacer spool to the bottom of the pressure isolation connector, wherein the spacer spool encases the assembled downhole tool;

connecting the spacer spool to the top of the blow out preventer;

equalizing the pressure in the at least one spacer spool and the pressure in the wellbore;

holding the pressure in the spacer spool with the lower packing gland;

activating the hydraulic assembly to extend the rod and downhole tool through the blow out preventer; and suspending the downhole tool in the blow out preventer with the internal rams of the blow out preventer.

2. The method of claim 1, further comprising the steps of:

releasing the pressure in the at least one spacer spool;

removing the spacer spools, pressure isolation connector and hydraulic assembly;

installing a coiled tubing injector on top of the blow out preventer;

connecting coiled tubing to the downhole tool; and lowering the downhole tool into the wellbore with the coiled tubing injector.

* * * * *